US007101266B2

(12) United States Patent
Grechishkin

(10) Patent No.: US 7,101,266 B2
(45) Date of Patent: Sep. 5, 2006

(54) ABRASIVE BLASTING DEVICE

(76) Inventor: Oleg Ivanovich Grechishkin, ZHSK, der. Sofyino, 18, Naro-Fominsky raion, Moskovskaya obl., 143395 (RU)

( * ) Notice: Subject to any disclaimer, the term of this patent is extended or adjusted under 35 U.S.C. 154(b) by 0 days.

(21) Appl. No.: 10/522,229

(22) PCT Filed: Jul. 23, 2003

(86) PCT No.: PCT/RU03/00358

§ 371 (c)(1),
(2), (4) Date: Sep. 28, 2005

(87) PCT Pub. No.: WO2004/009292

PCT Pub. Date: Jan. 29, 2004

(65) Prior Publication Data

US 2006/0128282 A1 Jun. 15, 2006

(30) Foreign Application Priority Data

Jul. 23, 2002 (RU) ..... 2002119454
Jul. 23, 2002 (RU) ..... 2002119455

(51) Int. Cl.
*B24C 5/04* (2006.01)
*B24C 9/00* (2006.01)

(52) U.S. Cl. ..... 451/102; 451/99; 451/101

(58) Field of Classification Search ..... 451/75, 451/77, 90, 91, 87, 101, 102
See application file for complete search history.

(56) References Cited

U.S. PATENT DOCUMENTS 3,854,997 A * 12/1974 Peck et al. ..... 134/7
4,384,434 A * 5/1983 Browning ..... 451/75
4,534,139 A * 8/1985 Desjardins ..... 451/101
5,605,497 A * 2/1997 Pickard ..... 451/90
5,607,342 A * 3/1997 Evdokimenko et al. ..... 451/75
5,947,800 A * 9/1999 Fring ..... 451/99

FOREIGN PATENT DOCUMENTS

EP 0 950 469 A2 10/1999
RU 2 167 756 A 5/2001
WO WO 88/05711 A1 8/1988
WO WO 99/39874 A1 8/1999
WO WO 01/81044 A1 11/2001

* cited by examiner

*Primary Examiner*—Dung Van Nguyen
(74) *Attorney, Agent, or Firm*—Rothwell, Figg, Ernst & Manbeck, PC

(57) ABSTRACT

An abrasive blasting device provides for both "cold" and "hot" processing. It includes a nozzle gun, an abrasive vessel, a batcher, an ejection-type mixer, a fuel tank, and a receiver. The nozzle gun includes a combustion chamber (108), a tubular element (114) for air/abrasive mixture feeding, a nozzle (128), swirlers of the fuel blend (122) and of gaseous oxidant (124). The combustion chamber (108) at a perforated wall area (110) has variable cross-section. The batcher includes independent regulation of a seat position with respect to a position of a slide-valve rod, and abrasive loosening and blow purging.

21 Claims, 6 Drawing Sheets

ABRASIVE BLASTING DEVICE

This application is a National Phase of International Application Serial No. PCT/RU03/00358, filed Jul. 23, 2003.

FIELD OF THE INVENTION

The invention relates to the area of abrasive blasting of surfaces of articles and structures and can be used in the industry, building, and in the other fields for processing and cleaning of surfaces from various types of pollution, in particular, prior to application of protective coatings.

BACKGROUND OF THE INVENTION

The efficiency of abrasive blasting is to a considerable extent determined by the energy-related factors of abrasive particles, namely, speed of ejection, uniform density of the generated gas/abrasive mixture flow and its temperature, and the possibility of its onstream regulation in the course of the process. That is why the bulk of publications consider optimization of the route "nozzle gun—means for air-abrasive mixture generation" to be a predominant factor in determining the quality and the capacity of the abrasive blasting.

Normally, two modes of abrasive blasting of surfaces are employed, namely, blasting using cold air/abrasive jet, and thermal abrasive blasting. In the first case, the flow of abrasive is being generated using high-velocity compressed air jet incoming directly from a compressor or another source, the main acting agent at that being the kinetic energy of the abrasive particles excited by this jet (cf., e.g., SU 0221534, Pichko, 01.08.1968; SU 1703425 A1, Marchuk et al., 07.01.1992; WO 99/39874, Seitter et al., 12.08.1999). In the second case, the device comprises a means for generating of high-temperature gas jet and its mixing with abrasive medium flow, usually located in the nozzle gun (cf., e.g., SU 0344977, Meerovich et al., 14.07.1972; WO 88/05711, Krivorozhsky ore and mining institute, 11.08.1988; U.S. Pat. No. 5,607,342, Evdokimenko et al., 04.03.1997; WO 01/81044 A1, Danilov et al., 01.11.2001; EP 1155781 A1, Thermo Blast International SA, 21.11.2001; UA 36316 A, Shpaket et al., 16.04.2001).

The common constituent parts of all surface abrasive blasting devices, irrespective of temperature mode of processing, are the nozzle gun and the mixer of abrasive with the carrier gas (air), connected to each other with a flexible hose. The mixer for abrasive is connected to the vessel for abrasive through a batcher. The feeding is carried out from a receiver connected to a compressed air source. The overpressure is also created in the abrasive tank, for which purpose the latter is also connected to the compressed air source for generating motion of the abrasive flow (cf., e.g., U.S. Pat. No. 5,947,800, Fring, 07.09.1999).

In the invention WO 88/05711 the nozzle gun of the device for surface thermal abrasive blasting comprises a body equipped with delivery pipes for liquid fuel and compressed air, a combustion chamber with radial through-holes being installed along its direct axis. The input to the combustion chamber is equipped with a swirl for swirling of the fuel blend. The nozzle for discharging of the high-temperature jet is installed at the output of the combustion chamber, the output orifice of gas/abrasive jet being located in its critical section. Liquid fuel and compressed air feeding pipes are located radially.

There is also a known jet device for thermal abrasive blasting comprising a body, which further comprises a combustion chamber with a prechamber, air flow swirlers located concentrically, a spray burner and a fuel blend homogenizer. The device comprises also a cooling jacket and a replacement nozzle embodied as a confuser and a choke tube conjugated on a curved surface. The jacket is connected to the chamber through radial holes (RU 2158197 C1, Danilov et al.; WO 01/81044).

There is also a known jet device for thermal abrasive blasting comprising an annular radial choice tube for fuel feeding to the combustion chamber providing for buildup of a protection film on its walls (RU 2163864 C2, OAO PO "Energoprom-Stroyzashchita", 10.03.2001).

The device (RU 2167756 C2, Kostritsa et al., 27.05.2001) comprises a pipeline of abrasive/air mixture with a swirler located around it. It further comprises a body, a regeneration pipe, a nozzle, a combustion chamber formed by the flue tube with radial holes and a swirler. Integrated in the case is a mixing chamber connected to fuel feeding channel and communicating with the oxidant feeding channel and the swirler. The end of the abrasive mixture feeding pipeline is located between the last row of radial holes and the input section of the nozzle. Fuel ignition is performed with an electric spark plug.

The jet device described in EP 1555781 is featured by a cylindrical body comprising concentrically located air cooling chamber formed by the sleeve and the solid wall fastened to each other forming a maze. The combustion chamber possesses a perforated wall and a tubular element for air/abrasive feeding equipped with feeding pipes for gaseous oxidant, liquid fuel and gas/abrasive mixture, respectively. It further comprises a swirler embodied as spiral channels for gaseous oxidant feeding for creation of the fuel blend, orifices for fuel input connected to the liquid fuel feeding pipe located between the combustion chamber perforated wall at its blank end and a tubular element. The output nozzle embodied as a Laval nozzle is equipped with a means for axial displacement and fastening to the cylindrical body. The ignition spark plug communicates with the combustion chamber.

Means for metering of abrasive input to the mixer to provide for uniform abrasive density in the jet device flow are described in a number of publications (cf., e.g., U.S. Pat. No. 5,433,653, Friess, 18.06.1995; EP 0694367 A1, Kegler, 31.01.96; EP 0950469 A2, Rickling, 20.10.1999). The publication (EP 0950469 A2, Rickling, 20.10.1999) describes the design of a blast valve using a movable choke remotely controlled by a pneumoengine. In the device described in another publication (EP 0694367, A1, Kegler, 31.01.96) the discharge orifice of the abrasive vessel comprises a regulating needle installed on a lever, the position of which is remotely controlled by a jack with a reducing gear. Such means for metering and transporting of an abrasive material to a mixer and further to a nozzle gun could only be employed for specially desiccated and prepared abrasive media with no caking trends. Otherwise, whirlwind formation and violation of abrasive feeding to the gas flow could occur, which makes the processing uncontrollable, hence irreproducible. Such violation of the technology would play the most essential role in case of thermal abrasive blasting due to uncontrollable abrasive feeding to the work area.

The analysis of the cited publications demonstrates the described devices to implement the modes of only either "cold" or "hot" abrasive jets. At the same time, there exists the demand in an abrasive blasting device that would provide for operation in both modes and would possess enhanced efficiency in both power requirements and operational features, namely, convenience of control, reduced consumption of abrasive, tool life in the thermal abrasive blasting mode, and stability of the abrasive jet. Of no less importance for a hand-held jet device are its weight and dimensions—these should be rather small.

SUMMARY OF THE INVENTION

The subject of the claimed invention is the device for abrasive blasting providing for both "cold" and "hot" abrasive blasting modes, enhanced velocity of abrasive particles on the nozzle exit, continuity and stability of the work jet. The subjects of the claimed invention are also enhancement of the stability and extension of the life of a nozzle through optimization of operational conditions and the novel design of the combustion chamber, possibility of simple and convenient regulation of the processing parameters irrespective of abrasive media conditions. The subject of the claimed invention is considerable reduction of the nozzle gun weight, design simplification, optimization of the ergonomics, which would enable facility of access and maintenance of the equipment.

The device for abrasive blasting comprises:

(a) a nozzle gun comprising:

a cylindrical body with an air-cooling chamber formed by a sleeve with a solid wall installed to form a maze, a combustion chamber with a perforated wall and a tubular element for air/abrasive mixture feeding connected to a feeding tube located concentrically and fastened to each other;

a swirler for the gaseous oxidant for preparing of the fuel blend, equipped with spiral grooves communicating with compressed air feeding pipe;

orifices connected with liquid fuel feeding pipe located on the combustion chamber input between the latter's perforated wall and the tubular element;

an output nozzle equipped with a means for axial displacement and fastening to the cylindrical body communicating with the air cooling chamber;

an ignition spark plug located in the combustion chamber;

(b) a tank for the liquid fuel the output of which communicates to the liquid fuel feeding pipe to the nozzle gun combustion chamber;

(c) an air/abrasive mixer comprising:

a vessel for abrasive, the output tube of which is connected through a batcher to an ejection-type mixer communicating to the air/abrasive channel feeding pipe of the nozzle gun;

(d) a receiver with a feeding pipe for connection to the compressed air source communicating to said vessel for abrasive and liquid fuel tank, with the ejector pipe of the mixer and with the compressed air channel feeding pipe of the nozzle gun.

The nozzle gun (a) comprises a swirler of the fuel blend, while the combustion chamber at its perforated wall area is embodied with variable cross-section and possesses at least one area narrowing with respect to end cylindrical sections.

The input part of the tubular element for air/abrasive mixture feeding is fastened to the body through two cylindrical spacers located concentrically forming between them the annular cavity for fuel feeding to the fuel blend swirler.

The first said cylindrical element possesses at one end a counterbore for fastening of the flange of the tubular element input part, and on the other end, through spiral grooves on the external surface operating as the fuel blend swirler, The second said cylindrical element possesses a lateral channel connected to the liquid fuel feeding pipe to said cavity, the external threaded part for fastening of the body, the counterbore for fastening the cooling chamber sleeve, and orifices connecting said cavity to the air cooling chamber.

The means for axial displacement and fastening of the output nozzle to the cylindrical body and to the combustion chamber cylindrical part can comprise a profile bush, a check-nut and a cylindrical holder fastened to the body. The profile bush can possess a groove for the nozzle, and the external surface can possess a flange and a threaded part ending with the recess conjugated with the internal thread of the cylindrical holder and the check-nut. The cylindrical holder can possess an annular chamber for cooling of the profile bush and the nozzle connected to the chamber for air cooling through axial holes communicating with the counterbore on the profile bush communicating with the combustion chamber.

The perforations of the wall of the combustion chamber can be located along the spiral the convolutions of which are parallel to the spiral grooves of the both swirlers.

The wall of the combustion chamber at the perforated part can be embodied corrugated.

The input part of the tubular element can be embodied conical, and said first cylindrical element can possess an external threaded part with the conical nut for fastening the hose to said conical part of the tubular element.

The device can be featured with the nozzle being embodied out of refractory abrasive-resistant ceramic material.

The batcher (c) of the air/abrasive mixer comprises a slide-valve rod and a seat with the axial channel and is equipped with a means for independent regulation of the seat position with respect to the position of the slide-valve rod and a means for abrasive loosening. The mixer is installed so as to provide for free rotation with respect to the output pipe of the abrasive vessel in case of changing of the hose position. The cylindrical body of the mixer is rigidly fastened to the batcher body and communicates thereto through the hole in the side wall. The batcher body from the seat side is connected to the output pipe of the abrasive vessel providing for seat rotation and displacement in the axial direction. The means for abrasive loosening is embodied as ribbing of the external part of the slide-valve rod beyond the zone of interaction with the seat, said rod possessing the through channel along the entire length communicating to the receiver in case of the batcher blow purging. The slide-valve rod is installed so as to provide its separate spinning and reciprocal motion, for which purpose its free end is connected to spinning and reciprocating drives.

The air/abrasive mixer can be also distinguished by the following. The means providing free spinning of the mixer with respect to the discharge pipe of the abrasive vessel and displacement of the seat in the axial direction is embodied as a flanged screwed cap and a mechanism for its spinning. The slide-valve rod drive can be embodied as at least one pneumatic drive linked to the mechanisms for rod spinning and axial reciprocating. The batcher can additionally comprise the means for throat regulation embodied as a bush of abrasive-resistant rubber being deformed in its cross-sectional plane by the plates linked to the drive and sliding along the guides.

BRIEF DESCRIPTION OF THE DRAWINGS

The essence of the invention is disclosed in figures, wherein.

DETAILED DESCRIPTION OF THE PREFERRED EMBODIMENT

Figure 1:
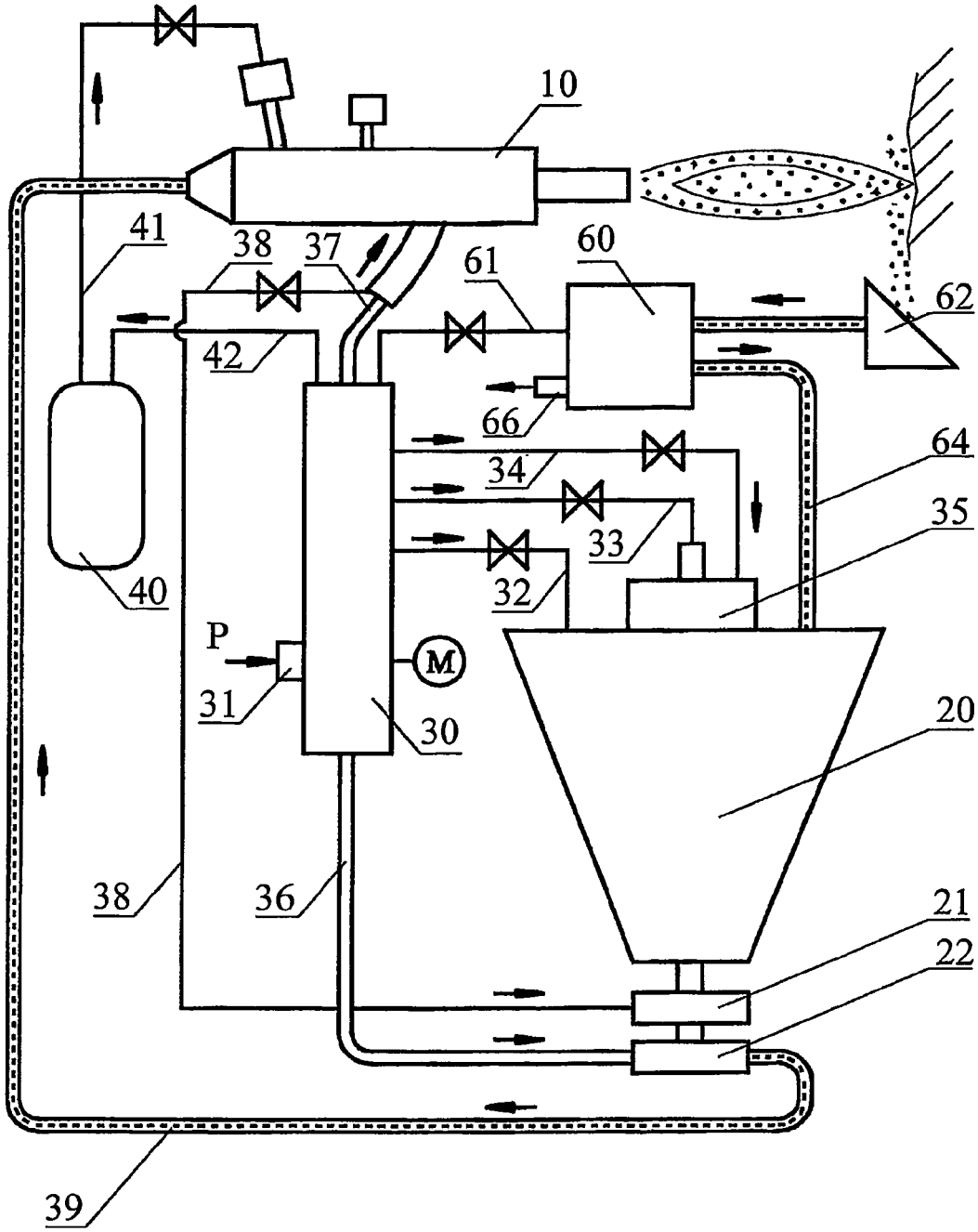
FIG. 1 represents the functional layout of the device.

The functional layout of the device for abrasive blasting is presented in FIG. 1. The device comprises the nozzle gun 10 with combustion chamber, the abrasive vessel 20 connected to the batcher 21 and ejection-type mixer 22. The device comprises further the receiver 30 equipped with the feeding line 31 for connection to the compressed air source.

Besides, the receiver 30 is connected via the hoses equipped with respective valves through the main 32 to the vessel 20 for its charging, through the main 33, to the blow purge system, and through the main 34, to the drive of the slide-valve rod mechanism 35 of the batcher 21.

Besides, the receiver 30 is connected through the main 36 to the compressed air union of the mixer 22, and through the hose 37 to the air feeding pipe of the nozzle gun 10. The said pipe is connected via the hose 38 with the batcher drive 21. The output pipe of the batcher 22 is connected via the hose 39 with the air/abrasive mixture feeding pipe to the nozzle gun 10. The device comprises the fuel tank 40 for liquid fuel connected via the hose 41 to the liquid fuel feeding pipe of the nozzle gun 10 combustion chamber. To ensure operation safety, the hose 41 due to its low cross-section can be laid inside the hose 37. The receiver 30 is connected via the main 42 to the tank 40 for liquid fuel charging.

The device can comprise an independent system 60 for recycling and separation of the spent abrasive connected to the receiver 30 via the main 61. The system 60 comprises the means 62 for collecting abrasive, the purified abrasive return main 64 connected to the vessel 20, and the discharge pipe 66 for waste disposal. FIG. 1 presents only the functional layout of the device not showing the elements usually employed to provide for operation and regulation of pneumatics functions, i.e. check valves, cocks, safety valves and other conventional elements. Such elements are known in the state of the art, used in accordance with their purpose and therefore not described.

The design of the nozzle gun is presented in FIGS. 2 to 6. The tool comprises a cylindrical body 102 with an air-cooling chamber 104 formed by the sleeve 106 with a solid wall installed to form a maze. The combustion chamber 108 comprises the wall 112 perforated with holes 110 and the tubular element 114 for air/abrasive mixture feeding. The device comprises the feeding pipe 116 for feeding compressed air (gaseous oxidant), the feeding pipe 118 for the liquid fuel and the feeding pipe 120 for air/abrasive mixture.

The device comprises the swirler 122 for the fuel blend connected to the liquid fuel feeding pipe 118, the swirler for the gaseous oxidant 124 connected to the compressed air feeding pipe 116. The swirlers 122, 124 are located between the perforated wall 112 of the combustion chamber 108 at its blind end and the tubular element 114.

The output nozzle 128 is equipped with a means 130 for axial displacement and fastening to the cylindrical body 102, and the spark plug 132 with the electrode 134 located in the combustion chamber 108.

Figure 2:
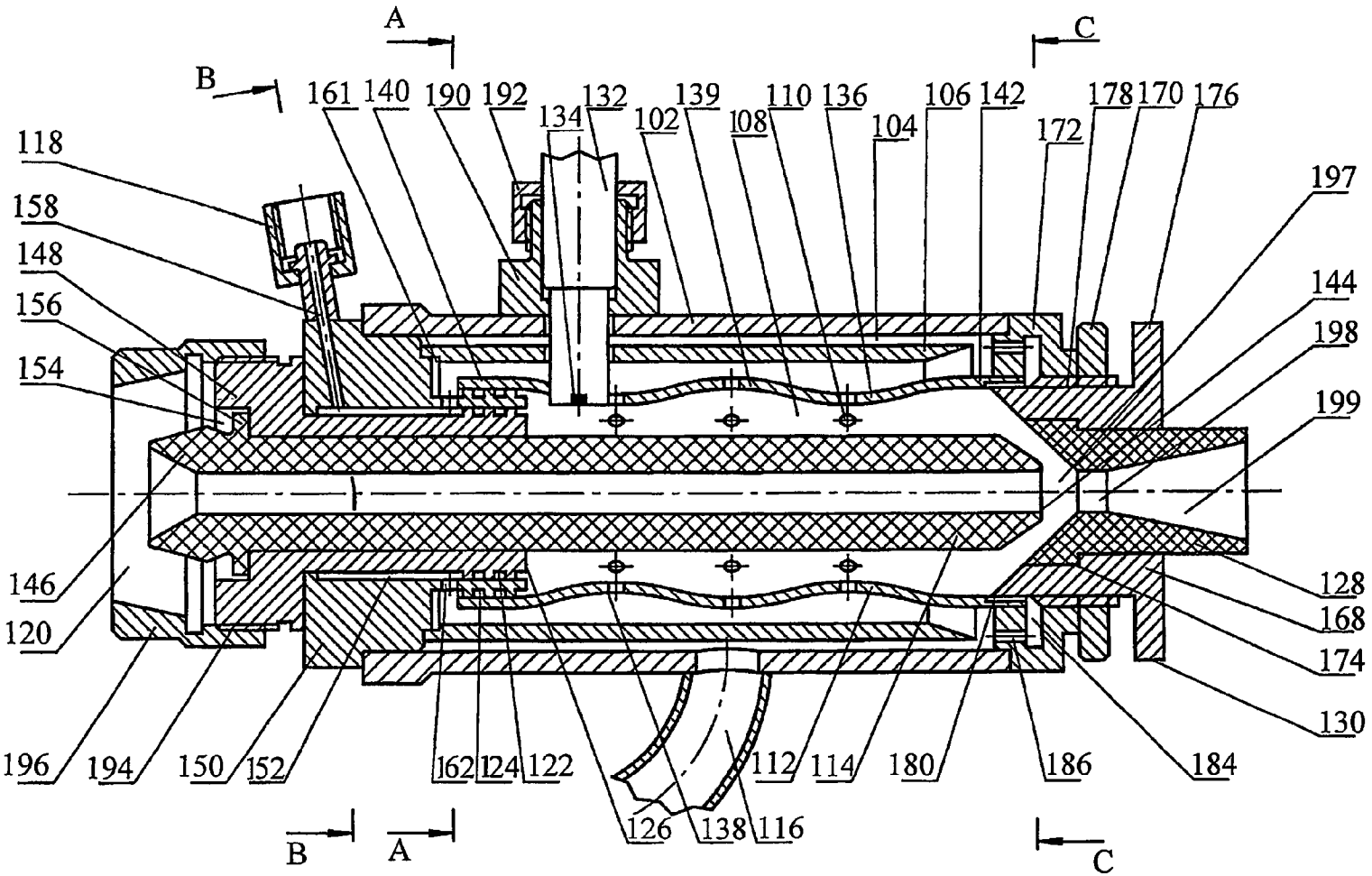
FIG. 2 is the longitudinal section of the nozzle gun structure.
Figure 3:
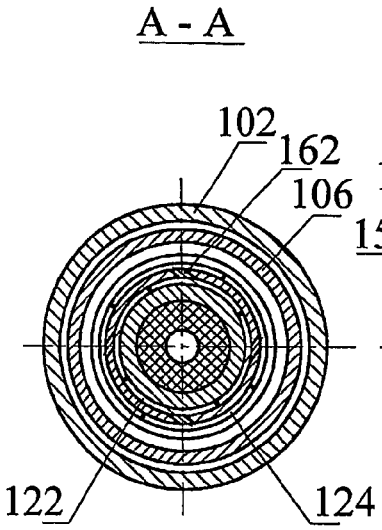
FIG. 3 is the cross-section of the structure shown in FIG. 2 along A—A.
Figure 4:
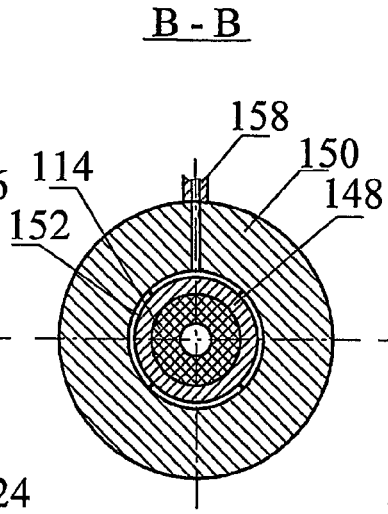
FIG. 4 is the cross-section of the structure shown in FIG. 2 along B—B.
Figure 5:
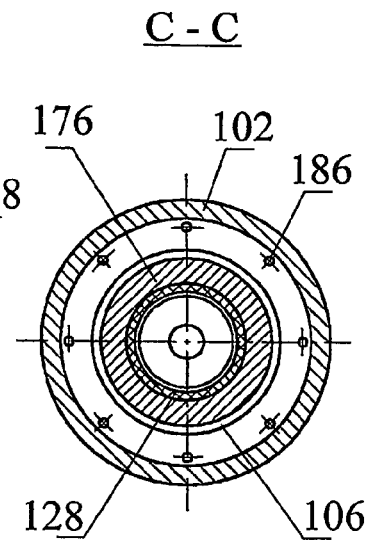
FIG. 5 is the cross-section of the structure shown in FIG. 2 along C—C.

The combustion chamber 108 at its wall area 112 perforated with holes 110 comprises at least one narrowing 136. FIG. 2 shows, as an example, two such narrowings 136, 138 with respect to end cylindrical sections 140, 142. Therefore, the cross-section of the combustion chamber wall 112 acquires corrugated profile. It has been shown experimentally that combustion chamber embodiment with variable cross-section along its longitudinal axis (which is to a certain extent similar to several Laval nozzles installed serially and turned to each other with their exit cross-sections) enables achieving a near-supersonic velocity of gas discharge in the chamber 108 at lower chamber length. Therefore, the velocity of gas flow at the exit of the nozzle 128 shall considerably exceed the sound velocity.

The said perforation with radial holes 110 is expedient to be carried out in the places of narrowings 136, 138 and the widening 139 (the widening does not exceed the chamber size in fastening places). If the device is embodied with a single narrowing (see item 138), it should be located away from the open end 144 of the tubular element 114 (that is, closer to swirlers 122, 124). The input part 146 of the tubular element 114 for air/abrasive mixture feeding is fastened to the body 102 through two cylindrical spacers 148, 150 forming between them the annular cavity 152 for fuel feeding to the swirlers 122 and 124. The first cylindrical element 148 possesses the counterbore 154 for fastening of the flange 156 of the tubular element 114 input part 146.

The second cylindrical element 150 possesses the lateral channel 158 connected to the liquid fuel feeding pipe 118 to the cavity 152, the counterbore 161 for fastening the cooling chamber sleeve 106, and orifices 162 connecting the cavity 152 to the air cooling chamber 104.

Figure 6:
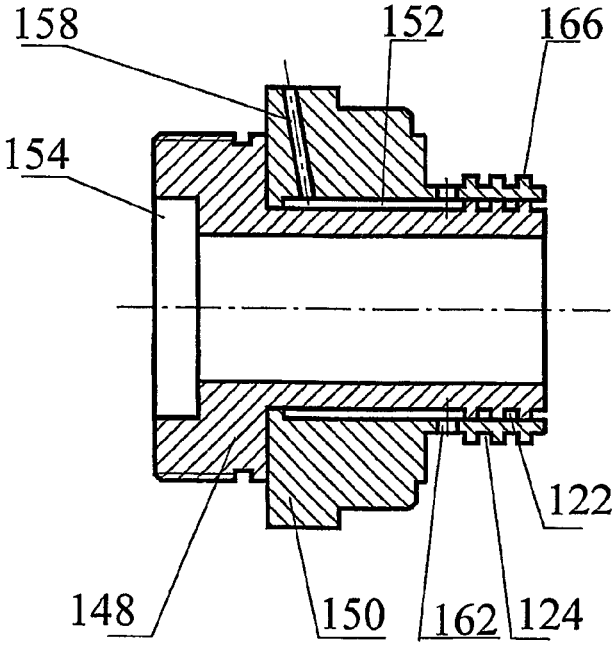
FIG. 6 shows the design of swirlers (outline)

Both swirlers 122, 124 are embodied on the end parts of cylindrical elements 148, 150 and constitute through spiral grooves 164 with convolutions 166 on their external surface (cf. FIG. 6).

The means 130 for axial displacement and fastening of the output nozzle 128 to the cylindrical body 102 and to the combustion chamber 108 cylindrical part comprise the profile bush 168, the check-nut 170 and the cylindrical holder 172 fastened to the body 102.

The profile bush 168 possesses the groove 174 for the nozzle 128. The external surface of the bush 168 possesses the flange 176 and the threaded part 178 ending with the recess 180. The threaded part 178 is conjugated with the internal thread 182 of the cylindrical holder 172 and the check-nut 170.

The cylindrical holder 172 possesses the annular chamber 184 for cooling of the profile bush 168 and the nozzle 128. The chamber 184 is connected to the chamber 104 for air cooling through axial holes 186 communicating with the counterbore 180 on the profile bush 168, communicating with the combustion chamber 108.

The electrode 134 of the spark plug 132 is located in the combustion chamber 108 flash with its wall 112. The spark plug 132 is installed in the openings of the body 102, sleeve 106 and wall 112 through the sleeve 190 attached to the body 102, and the screwed cap 192.

The first cylindrical element 148 possesses the external threaded part 194 connected to the conical nut 196 for fastening the hose (the hose not shown) to the input part 146 of the tubular element 114. The input part 146 is embodied conical, therefore, the nut 196, due to crimping, fastens the hose reliably.

The nozzle 128 is embodied as a Venturi tube and possesses a narrowing part 197, a critical section 198 and a widening part 199. The nozzle 128 shall be embodied of refractory abrasive-resistant ceramic materials.

FIGS. 7 to 13 represent the design of air/abrasive mixer and its component parts.

Fastened to the body of the vessel 210 for the abrasive in its lower part is the conical element 212 with the discharge pipe 214. The vessel has in its upper part the charging hole equipped with the cover (not shown). The conical element is fastened to the body 210 via the flange connection 216. Connected to the discharge pipe is the batcher 218 comprising the slide-valve rod 220 and the seat 222 with the axial relief channel 224, which can be embodied out of a segment of an abrasive-resistant rubber hose. The batcher is fastened to the ejection-type mixer 226 and communicates with the latter through the hole 227 in the side wall.

The mixer 226 possesses the union 228 for connecting to the compressed air source and the discharge output pipe 230 for connecting of the flexible hose (FIG. 1, item 39) to the feeding pipe for air/abrasive mixture feeding to the nozzle gun. The mixer 226 is equipped with a sparger, for which purpose the web 232 is installed on the part of the mixer body. The web 232 also serves to prevent abrasive buildup in the throat of the mixer 226 in the idle state. Splitting of the compressed air flow incoming through the union 228 in the course of the operation provides subsequently for enhancing the turbulization of the air/abrasive mixture due to interaction of the upper and lower portions of the flow beyond the web 232.

The slide-valve rod 220 is embodied hollow, the hollow cone 234 being fixed to its lower part, the latter one operating as a sliding valve, with the through hole 236 in the apex of the cone and ribs 237 installed at its non-working surface and intended for abrasive loosening in case of seat jamming. The bush 238 installed in the conical element 212 is intended for rod 220 alignment.

Figure 7:
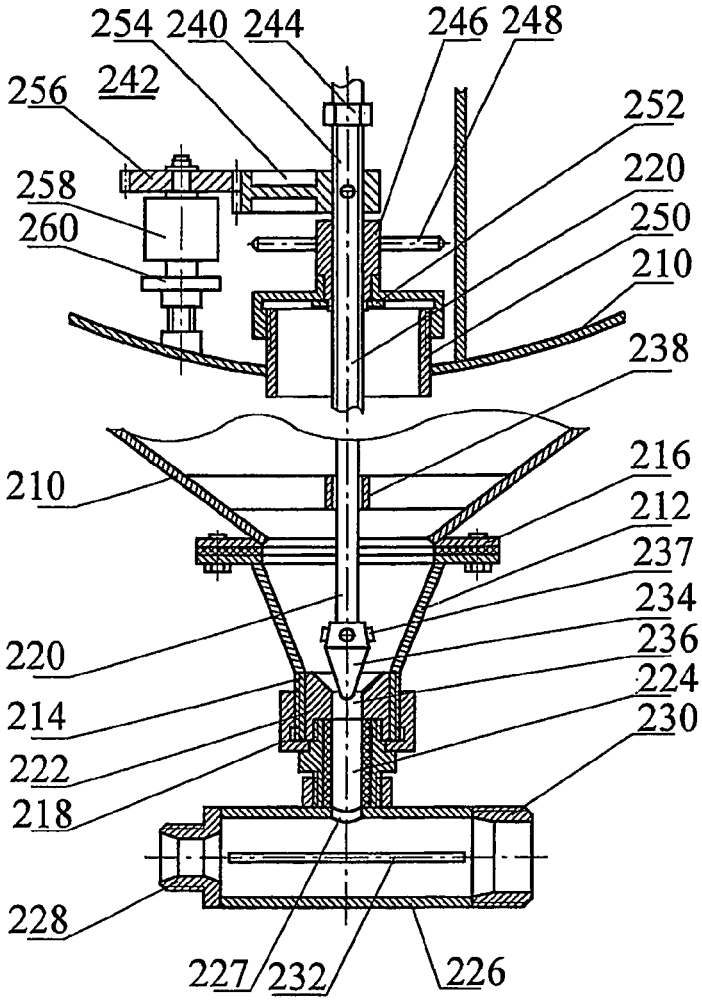
FIG. 7 shows the design of air/abrasive mixer.

The slide-valve rod 220 is installed so as to provide for independent spinning and axial reciprocating. One of the embodiments of this mechanism is shown in FIG. 7. The free end 240 of the rod 220 is hermetically brought to the upper part of the body 210 of the abrasive vessel; it is threaded and linked to the drive 242. To connect the batcher to the receiver for blow purging, the union 244 is provided at the free end 240 of the rod 220. Vertical displacement of the cone 234 is performed by the nut 246 with handles 248 with the thread matching the thread on the free end 240 of the rod. The nut 246 is installed so as to provide rotation with respect to the bush 250 installed hermetically in the body 210 and is equipped with fastening and sealing components 252. The driven gear 254 toothed with the driving gear 256 is fastened to the rod 220; the driving gear 256 is linked to the pneumatic engine 258 installed on the body 210 through the fixture 260.

Figure 8:
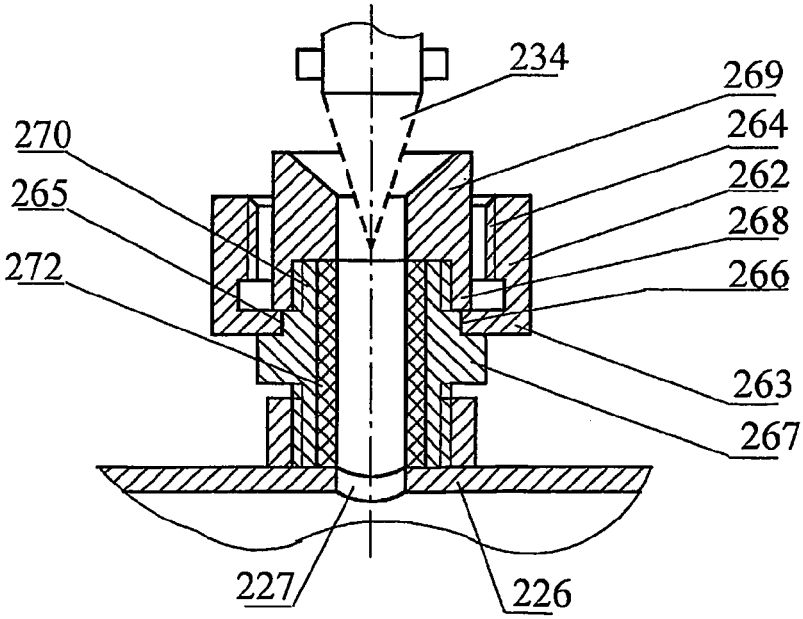
FIG. 8 shows the batcher design.
Figure 9:
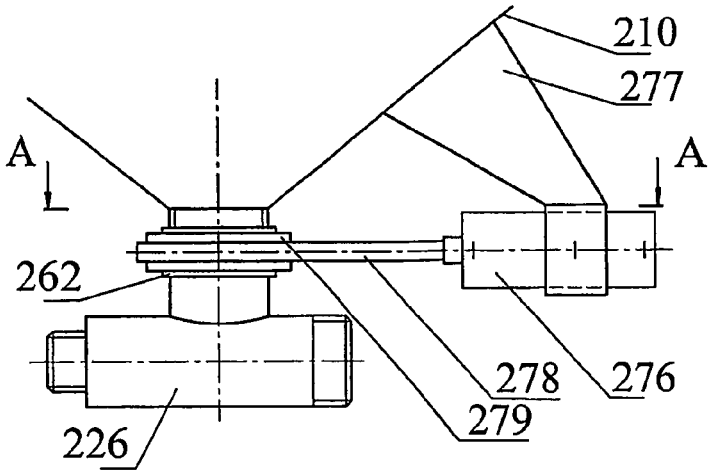
FIG. 9 is the batcher regulating drive.
Figure 10:
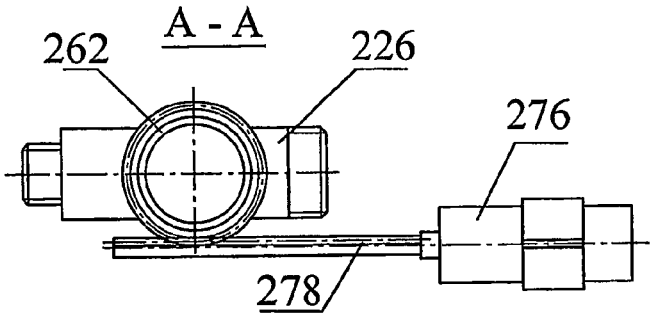
FIG. 10 is the same as FIG. 9, view along A—A.

FIG. 8 outlines the means for provision of free spinning of the mixer 226 with respect to the discharge pipe 212 of the body 210 of the abrasive vessel and for seat 222 displacement in the axial direction. These means are embodied as a screwed cap 262 with the flange 263, with its internal threading 264 matching the external thread of the discharge pipe 214 of the abrasive vessel. The flange 263 is installed freely in the annular mortise 265 between the groove 266 on the body 267 and the rear surface 268 of the seat bush 269 linked by the threaded coupling 270 and the bearing bush 272. It is expedient to embody the seat bush 269 wear-resistant, for example, as a metal rubber-bonded bush.

Such embodiment enables regulation of the batcher effective section through lifting or lowering of the bush 269 by means of cap 262 rotation. At the same time, this solution enables free spinning of the mixer in the horizontal plane following movements of the abrasive blasting operator's hose without overbending, hence without abrading at bends.

Rotation of the cap 262 for regulation of the batcher seat horizontal position can be easily mechanized through employing an additional pheumatic geared drive, similarly to the way described for the drive 242. A variant of such design is presented in FIGS. 9, 10. The pneumocylinder 276 is fastened to the bottom part of the abrasive vessel body 210 via the bracket 277. The rod 278 of the pneumocylinder is toothed to the pinion 279 integral with the cap 262. Translational motion of the pneumocylinder rod makes the cap 262 travel up or down along the thread 264, thereby performing the regulation of the batcher 218 effective section.

Figure 11:
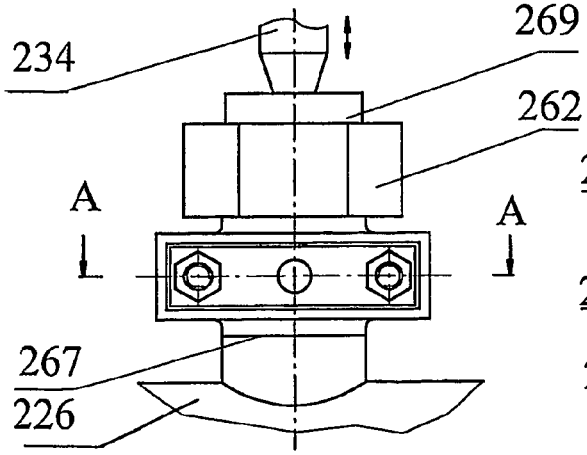
FIG. 11 is the batcher regulating drive with deformable bush.
Figure 12:
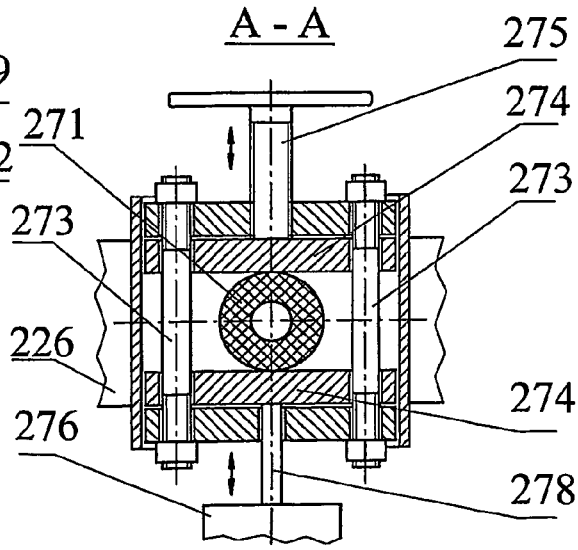
FIG. 12 is the same as FIG. 11, view along A—A.

FIGS. 11 and 12 represent the variant of the embodiment of batcher 218 effective section regulation through a deformable bush 271. In this case, the bush 271 is embodied of rubber, for example, of a section of an abrasive-resistant hose. The bush is crimped with plates 274 travelling along the guides 273; The travel of plates 274, that is, partial or complete cutting-off the batcher throat, can be performed both via the rod 278 of the pneumocylinder 276 and manually, with the tommy 275.

Figure 13:
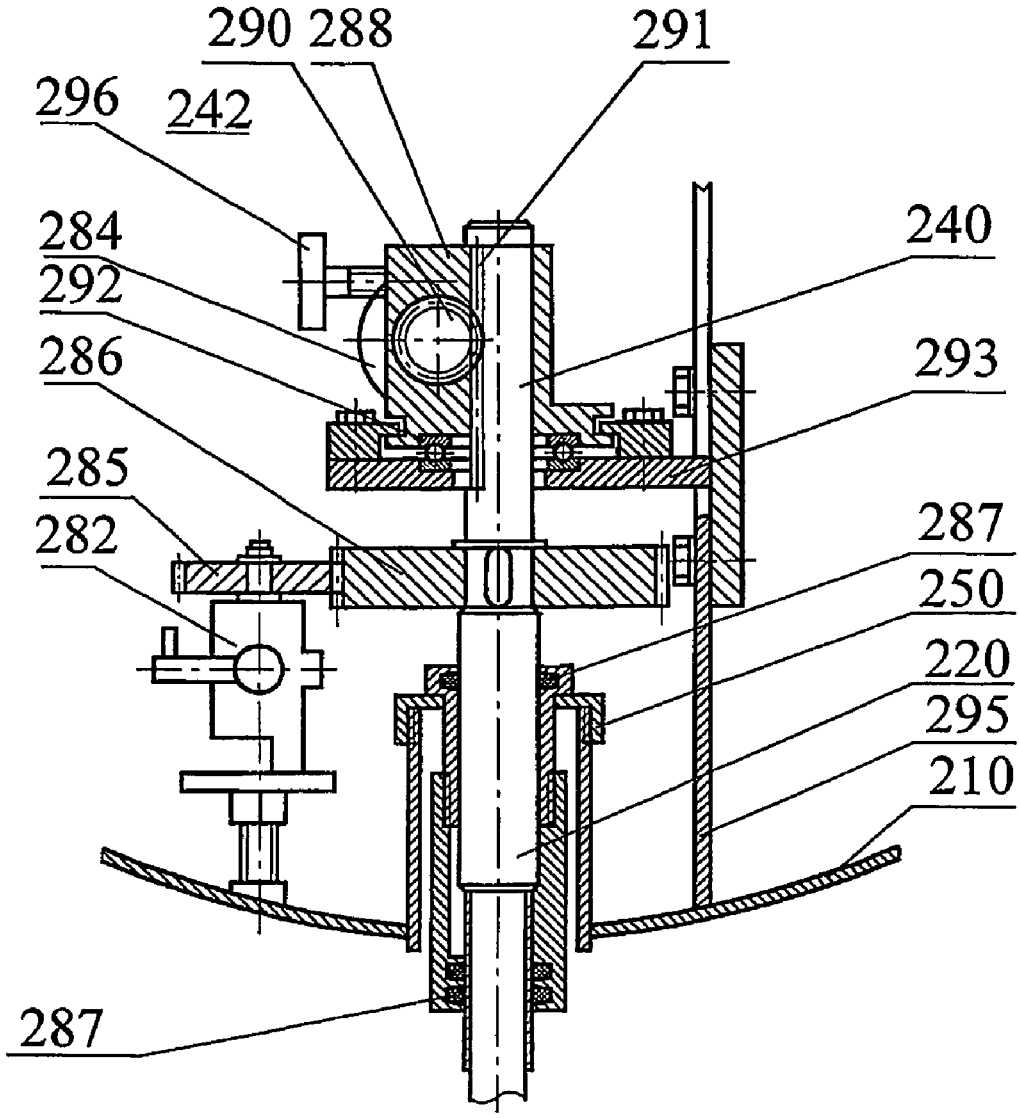
FIG. 13 is the slide-valve rod drive.

FIG. 13 represents another variant of drive 242 embodiment, distinct from that of FIG. 7. This variant enables manipulations in axial translation of the rod 242 providing its spinning. This is achieved through two pneumatic engines 282, 284. The engine 282 is installed on the body 210 and is equipped with a driving gear 285 toothed to the driven gear 286 fastened on the rod 220. The rod 220 is installed in the body 210 of the abrasive vessel and is capable of axial translation and spinning through the bush 250 possessing sealing units 287 equipped with packing glands. The unit 288 of vertical translation is driven from the pneumatic engine 284 equipped with the pinion 290 toothed to the rack 291 formed at the end 240 of the rod 220.

The unit 288 is installed so as to enable its travel in the horizontal plane. For this purpose, the unit 288 is installed on the slide 292 travelling along the base 293 fastened to the wall 295. On toothing of the pinion 290 and the rack 291, the gear is fixed with the screw 296.

Providing for rod 220 reciprocating can be also implemented employing other known mechanisms of pneumatic and electric automation used in conditions of heavy dust load.

Prior to operation the vessel 20 is charged with the abrasive through the charging window. The abrasive to be used can be powders of abrasive materials, metallurgy wastes, namely slugs, sand and similar media. The batcher 21 shall be locked prior to operation. For this purpose, the slide-valve rod 220 is brought to contact the seat 222 (FIG. 7). Then an overpressure is created in the vessel 20; to do so, the respective cock in the main 32 connecting the vessel with the receiver 30 is opened, and the compressed air is fed to the mixer 22.

The throat of the batcher 218 is regulated with the screwed cap 262. Due to this, the required amount of the abrasive is fed through the axial relief channel 224 to the ejection-type mixer 226 and further mixed with the compressed air flow thereby forming the air/abrasive mixture. The air/abrasive mixture is further fed through the feeding pipe 230 of the mixer 22 via the hose 39 to the nozzle gun 10, wherein it is accelerated and prepared for sandblasting operation as such. Depending on the used design, the cap 262 is rotated either manually (FIG. 7) or with the gear set "pinion 279 rack on the rod 278" by means of the pneumocylinder 279 (FIG. 9) remotely operated by the operator through application of the pressure to the main 38 with the respective cock. In the other variant of the embodiment (FIGS. 11, 12), the regulation of the abrasive consumption is performed through crimping of the deformable bush 271 either by means of the pneumocylinder 276 remotely operated by the operator via the main 38 or manually, with the tommy 275.

In the course of the operation, the feeding of the air/abrasive mixture is conveniently regulated through variation of the position of the hollow cone 234 of the slide-valve rod 220 with respect to the seat 222 by means of rotation of the screwed cap 246 (FIG. 7), either manually or with the drive 242 "pinion 290-rack 291" (FIG. 13).

Should any interruptions in generation of the air/abrasive mixture occur, this could testify to violations of the flowing regime in the channel 227, for example, due to abrasive poor condition and/or excessive humidity. In such a case, the slide-valve rod 220 is being spin from the mechanical drives 242 with pneumatic engines 258, 282 (FIGS. 7, 13). For the drive shown in FIG. 13, prior to this the screw 296 is loosened and the gear untoothed. Ribs 237 perform abrasive loosening in the seat area. Should the abrasive be jammed in the channel 224, the compressed air is fed from the receiver 30 directly to the rod cavity 220. In this case, blow purging with the air discharged through the opening 236 in the cone apex shall remove the jamming. In practice, in case of violation of air/abrasive mixture forming regime, it is expedient to combine loosening by rod 220 spinning and blow purging of the rod 220 with air.

The device enables blasting with both hot air/abrasive jet and cold air/abrasive jet.

A) The Mode of Cold Air/Abrasive Jet Generation

The respective work media are fed via hoses 37, 39 connected respectively to compressed air feeding pipe 116 and air/abrasive mixture feeding pipe 120 to the nozzle gun. The air/abrasive mixture is fed through the tubular element 114 to the narrowing part 197 of the nozzle. The compressed air from the air cooling chamber 104 is fed under pressure to the same zone. Further the compressed air is fed through perforated radial holes 110 to the open end of the tubular element 114. The ejection of the air/abrasive mixture into the output nozzle 128 (Venturi tube), acceleration in this nozzle and ejection of high-velocity abrasive jet occurs within this area. Provided proper adjustment of the position of the element 114 with respect to the nozzle 128 in the longitudinal (axial) direction, which is performed through rotation of the profile bush 168 with subsequent locking with the check-nut 170, the optimum rate of atomization can be reached. The abrasive consumption, as it has been indicated above, is governed both by the batcher 21 and in the mixer 22 through variation of the pressure of the compressed air fed from the receiver 30. Further the abrasive blasting itself is performed.

B) The Mode of Hot Air/Abrasive Jet Generation

The respective work media, viz. the compressed air playing the role of the gaseous oxidant, the air/abrasive mixture and the liquid fuel are fed via mains 37, 39, 41 to the nozzle gun 10. The air/abrasive mixture is fed via the tubular element 114 to the nozzle 197 zone.

Due to the overpressure in the liquid fuel tank 40 (supercharging is carried out via the mains 42), the fuel is squeezed through the lateral channel 158 to the annular cavity 152 and further to the combustion chamber 108 via through spiral grooves 164 playing the role of the swirler 122. At the same time, the fuel is squeezed through orifices 162 to the pressurized air cooling chamber 104, entrapped with the air counter-stream and ejected by the air through the swirler 124. Due to the action of both swirlers 122, 124, two streams swirled in the same direction are fed to the chamber 108, the stream of the dispersed liquid fuel and the stream if the fuel blend. The fuel and the oxidant are mixed in the swirled streams and flow along the wall 112 of the combustion chamber 108, the density of the fuel blend increasing at the chamber wall 112. The fuel in the blend is further atomized and saturated with the gaseous oxidant fed to the combustion chamber 108 through perforated radial holes 110 located along the spiral with convolutions being parallel to the convolutions of spiral grooves of the both swirlers.

At the startup stage of the nozzle gun 10, filling of the entire volume of the combustion chamber 108 is achieved, which is controlled by appearance of the aerosol cloud from the nozzle 128. Then the spark plug 132 is initiated with its electrode 134 located in the combustion chamber 108. The stable burning of the fuel is achieved through regulation of its feed rate and of gaseous oxidant consumption. Then consumption of the air/abrasive mixture fed to the burning gas jet is regulated.

The overheating of the case 102 of the gun 10 (in the steady-state operation mode its temperature does not exceed 60° C.) is prevented by the compressed air stream cooling the air cooling chamber 104. This stream through the perforated holes 110 is fed to the combustion chamber 108. Reducing the temperature of both the nozzle 120 and the gun in the whole is promoted by feeding of the compressed air from the chamber 104 through the axial holes 186 into the annular chamber 184 cavity. The air is discharged through the recess 180 into the combustion chamber 108 to the open end 144 of the tubular element 114.

Then the ejection of the air/abrasive mixture with the combustion products to the output nozzle 128 (Venturi tube), acceleration in the nozzle and ejection of the high velocity gas/abrasive mixture occurs. Provided proper adjustment of the position of the element 114 with respect to the nozzle 128 in the longitudinal (axial) direction, which is performed through rotation of the profile bush 168 with subsequent locking with the check-nut 170, the optimum rate of atomization can be reached. The consumption of the abrasive and of the liquid fuel, as well as the compressed air pressure are regulated directly in the mixer, fuel tank and the receiver, and also with the respective cocks. Further the abrasive blasting is performed with the generated jet.

The experiments have demonstrated the gas jet velocity from the nozzle in the commercial devices manufactured according to the claimed invention to reach 2.0 to 2.5 Mach. The velocity of ejected abrasive material particles depending on the nozzle gun selected parameters may exceed 500 m/s the gas temperature being 800 to 1200° C. The nozzle gun is ca. 250 mm long with the mass of ca. 1.5 kg.

The device provides for surface processing capacity of up to 50 $m^2$/hr at metallurgical slag consumption ca. 7 kg/$m^2$.

INDUSTRIAL APPLICABILITY

The claimed device can be implemented according to the present disclosure employing conventional machine engineering technologies and materials.

It will be apparent to those skilled in the art that although the present invention has been described in terms of an exemplary embodiment, modification and changes may be made to the disclosed embodiment without departing from the essence of the invention.

The invention claimed is:

1. The device for the abrasive blasting comprising:

(a) a nozzle gun (10), comprising:

a cylindrical body (102) with an air-cooling chamber (104) formed by a sleeve (106) with a solid wall installed to form a maze, a combustion chamber (108) with a perforated wall (112) and a tubular element (114) for air/abrasive mixture feeding connected to a feeding tube (120) located concentrically and fastened to each other;

a swirler (124) for the gaseous oxidant for preparing of the fuel blend, equipped with spiral grooves communicating with compressed air feeding pipe (116);

orifices (162) connected with liquid fuel feeding pipe (118) located on the combustion chamber input between the latter's perforated wall and the tubular element;

an output nozzle (128) equipped with a means for axial displacement and fastening to the cylindrical body communicating with the air cooling chamber;

an ignition spark plug (132) located in the combustion chamber;

(b) a tank (40) for the liquid fuel the output of which communicates to the liquid fuel feeding pipe to the nozzle gun combustion chamber;

(c) an air/abrasive mixer comprising a vessel (20) for abrasive, the output tube of which is connected through a batcher (21) to an ejection-type mixer (22) communicating to the air/abrasive channel feeding pipe of the nozzle gun;

(d) a receiver (30) with a feeding pipe for connection to the compressed air source communicating to said vessel (20) for abrasive and liquid fuel tank (40), with the ejector pipe of the mixer and with the compressed air channel feeding pipe of the nozzle gun, wherein the nozzle gun (a) (10) comprises a swirler (122) of the fuel blend, while the combustion chamber (108) at its perforated wall area (110) is embodied with variable cross-section and possesses at least one area (136, 138) narrowing with respect to end cylindrical sections (140, 142);

the input part (146) of the tubular element (114) for air/abrasive mixture feeding is fastened to the body through two cylindrical spacers (148, 150) located concentrically forming between them the annular cavity (152) for fuel feeding to the fuel blend swirler (122);

the first said cylindrical element (148) possesses at one end a counterbore (154) for fastening of the flange of the tubular element input part, and on the other end, the through spiral grooves (164) on the external surface operating as the fuel blend swirler;

the second said cylindrical element (150) possesses a lateral channel (158) connected to the liquid fuel feeding pipe (118) to said cavity, the external threaded part (194) for fastening of the body, the counterbore (161) for fastening the cooling chamber sleeve, and orifices (162) connecting said cavity (152) to the air cooling chamber (104).

2. The device according to claim 1, wherein the means (130) for axial displacement and fastening of the output nozzle (128) to the cylindrical body (102) and to the combustion chamber (108) cylindrical part comprises a profile bush (168), a check-nut (170) and a cylindrical holder (172) fastened to the body, the profile bush (168) possesses a groove (174) for the nozzle, and the external surface possesses a flange (176) and a threaded part (178) ending with the recess (180) conjugated with the internal thread of the cylindrical holder and the check-nut;

the cylindrical holder (172) possesses an annular chamber for cooling of the profile bush and the nozzle connected to the chamber (104) for air cooling through axial holes (186) communicating with the counterbore on the profile bush communicating with the combustion chamber.

3. The device according to claim 1, wherein the perforations (110) of the wall (112) of the combustion chamber are located along the spiral the convolutions of which are parallel to the spiral grooves of the both swirlers (122, 124).

4. The device according to claim 1, wherein the wall (112) of the combustion chamber at the perforated part (110) is embodied 25 corrugated.

5. The device according to claim 1, wherein the input part (146) of the tubular element is embodied conical, and said first cylindrical element (148) possesses an external threaded part with the conical nut for fastening the hose to said conical part of the tubular element.

6. The device according to claim 1, wherein the nozzle (128) is embodied out of refractory abrasive-resistant ceramic material.

7. The device according to claim 1, wherein the air/abrasive mixer (c) possessing the hatcher (21, 218) comprises a slide-valve rod (220) and a seat (222) with the axial channel and is equipped with a means for independent regulation of the seat (222) position with respect to the position of the slide-valve rod and a means (237) for abrasive loosening;

the mixer (22, 226) is installed so as to provide for free rotation with respect to the 10 output pipe (230) of the abrasive vessel (210) in case of changing of the hose (39) position;

the cylindrical body of the mixer is rigidly fastened to the batcher body and communicates thereto through the hole (227) in the side wall;

the batcher (218) body from the seat (222) side is connected to the output pipe (214) of the abrasive vessel providing for seat rotation and displacement in the axial direction;

the means for abrasive loosening is embodied as ribbing (237) of the external part of the slide-valve rod (220) beyond the zone of interaction with the seat, said rod possessing the through channel along the entire length (244) communicating to the receiver (30) in case of the batcher blow purging;

the slide-valve rod (220) is installed so as to provide its separate spinning and reciprocal motion, for which purpose its free end (240) is connected to spinning and reciprocating drives (242).

8. The device according to claim 7, wherein the means providing free spinning of the mixer (226) with respect to the discharge pipe (214) of the abrasive vessel and displacement of the seat (222) in the axial direction is embodied as a flanged screwed cap (262), with its internal threading matching the external thread of the discharge pipe (214) of the abrasive vessel, the flanging being installed freely in the annular mortise between the groove (266) on the batcher body and the rear surface (268) of the seat bush linked by the threaded coupling (270).

9. The device according to, wherein the screwed cap (262) is linked to the mechanism for its spinning, preferably through an additional pneumatic drive (276) with rack-and-pinion gear, the pinion (279) 5 being linked to the screwed cap (262).

10. The device according to claim 7, wherein the slide-valve rod drive is embodied as at least one pneumatic drive (242) linked to the mechanisms for rod spinning and axial reciprocating (290, 291).

11. The device according to claim 7, wherein the batcher additionally comprises the means for throat regulation embodied, as a bush (271) of abrasive-resistant rubber being deformed in its cross-sectional plane by the plates (274) linked to the drive and sliding along the guides (273).

12. The nozzle gun (a) for the device for the abrasive blasting comprising: a cylindrical body (102) with an air-cooling chamber (104) formed by a sleeve (106) with a solid wall installed to form a maze, a combustion chamber (108) with a perforated wall (112) and a tubular element (114) for air/abrasive mixture feeding connected to a feeding tube (120) located concentrically and fastened to each other;

a swirler (124) for the gaseous oxidant for preparing of the fuel blend, equipped with spiral grooves communicating with compressed air feeding pipe (116);

orifices (162) connected with liquid fuel feeding pipe (118) located on the combustion chamber input between the latter's perforated wall and the tubular element;

an output nozzle (128) equipped with a means for axial displacement and fastening to the cylindrical body communicating with the air cooling chamber;

an ignition spark plug (132) located in the combustion chamber, wherein additionally a swirler (122) of the fuel blend is comprised, while the combustion chamber(108) at its perforated wall area (110) is embodied with variable cross-section and possesses at least one area (136, 138) narrowing with respect to end cylindrical sections (140,142);

the input part (146) of the tubular element (114) for air/abrasive mixture feeding is fastened to the body through two cylindrical spacers (148, 150) located concentrically forming between them the annular cavity (152) for fuel feeding to the fuel blend swirler (122);

the first said cylindrical element (148) possesses at one end a counterbore (154) for fastening of the flange of the tubular element input part, and on the other end, through spiral grooves (164) on the external surface operating as the fuel blend swirler;

the second said cylindrical element (150) possesses a lateral channel (158) connected to the liquid fuel feeding pipe (118) to said cavity, the external threaded part (194) for fastening of the body, the counterbore (161) for fastening the cooling chamber sleeve, and orifices (162) connecting said cavity (152) to the air cooling chamber (104).

13. The device according to claim 12, wherein the means (130) for axial displacement and fastening of the output nozzle (128) to the cylindrical body (102) and to the combustion chamber (108) cylindrical part comprises a profile bush (168), a check-nut (170) and a cylindrical holder (172) fastened to the body, the profile bush (168) possesses a groove (174) for the nozzle, and the external surface possesses a flange (176) and a threaded part (178) ending with the recess (180) conjugated with the internal thread of the cylindrical holder and the check-nut;

the cylindrical holder (172) possesses an annular chamber for cooling of the profile bush and the nozzle connected to the chamber (104) for air cooling through axial holes (186) communicating with the counterbore on the profile bush communicating with the combustion chamber.

14. The device according to claim 12, wherein the perforations (110) of the wall (112) of the combustion chamber are located along the spiral the convolutions of which are parallel to the spiral grooves of the both swirlers (122, 124).

15. The device according to claim 12, wherein the wall (112) of the combustion chamber at the perforated part (110) is embodied corrugated.

16. The device according to claim 12, wherein the input part (146) of the tubular element is embodied conical, and said first cylindrical element (148) possesses an external threaded part with the conical nut for fastening the hose to said conical part of the tubular element.

17. The device according to claim 12, wherein the nozzle (128) is embodied out of refractory abrasive-resistant ceramic material.

18. The air/abrasive mixer (c) for the device for the abrasive blasting comprising:

a vessel (20) for abrasive, the output tube (214) of which is connected through a batcher (21) to an ejection-type mixer (22);

a discharge output pipe 230 of the mixer connected with a flexible hose to the feeding tube (120) for air/abrasive mixture feeding to the nozzle gun (10);

a means (30, 36) for abrasive vessel (20) and union (228) of the mixer ejector pipe connecting to the receiver, wherein the batcher (21, 218) comprises a slide-valve rod (220) and a seat (222) with the axial channel and is equipped with a means for independent regulation of the seat (222) position with respect to the position of the slide-valve rod and a means (237) for abrasive loosening;

the mixer (22, 226) is installed so as to provide for free rotation with respect to the output pipe (230) of the abrasive vessel (210) in case of changing of the hose (39) position;

the cylindrical body of the mixer is rigidly fastened to the batcher body and communicates thereto through the hole (227) in the side wall;

the batcher (218) body from the seat (222) side is connected to the output pipe (214) of the abrasive vessel providing for seat rotation and displacement in the axial direction;

the means for abrasive loosening is embodied as ribbing (237) of the external part of the slide-valve rod (220) beyond the zone of interaction with the seat, said rod possessing the through channel along the entire length (244) communicating to the receiver (30) in case of the batcher blow purging;

the slide-valve rod (220) is installed so as to provide its separate spinning and reciprocal motion, for which purpose its free end (240) is connected to spinning and reciprocating drives (242).

19. The device according to claim 18, wherein the means providing free spinning of the mixer (226) with respect to the discharge pipe (214) of the abrasive vessel and displacement of the seat (222) in the axial direction is embodied as a flanged screwed cap (262), with its internal thread (264) matching the external thread of the discharge pipe (214) of the abrasive vessel, the flanging (263) being installed freely in the annular mortise between the groove (266) on the batcher body and the rear surface (268) of the seat bush linked by the threaded coupling (270).

20. The device according to claim 18, wherein the screwed cap (262) is linked to the mechanism for its spinning, preferably through an additional pneumatic drive (276) with rack-and-pinion gear, the pinion (279) being linked to the screwed cap (262).

21. The device according to claim 18, wherein the slide-valve rod drive is embodied as at least one pneumatic drive (242) linked to the mechanisms for rod spinning and axial reciprocating (290, 291).

* * * * *